United States Patent [19]

Dykstra

[11] Patent Number: 4,733,413

[45] Date of Patent: Mar. 29, 1988

[54] GLOVE CONSTRUCTION AND METHOD OF MAKING

[75] Inventor: Martin Dykstra, Grandville, Mich.

[73] Assignee: Shelby Group International, Inc., Memphis, Tenn.

[21] Appl. No.: 22,015

[22] Filed: Mar. 5, 1987

[51] Int. Cl.[4] ..... A41D 19/00

[52] U.S. Cl. ..... 2/169; 2/164

[58] Field of Search ..... 2/164, 167, 168, 159, 2/163, 158, 169

[56] References Cited

U.S. PATENT DOCUMENTS

| | | | |
|---|---|---|---|
| 211,614 | 1/1879 | Allerton | 2/164 |
| 2,004,382 | 6/1935 | Palicki | 2/164 |
| 2,072,541 | 3/1937 | Burnham | 2/164 |
| 3,114,915 | 12/1963 | Gross | 2/164 X |
| 3,625,790 | 12/1971 | Ayres | 156/93 |
| 3,869,726 | 3/1975 | Bell | 2/159 |
| 3,879,764 | 4/1975 | Weber-Liel | 161/190 |
| 4,194,041 | 3/1980 | Gore et al. | 428/424 |
| 4,209,857 | 7/1980 | Clark, Jr. et al. | 2/169 |
| 4,430,759 | 2/1984 | Jackrel | 2/159 X |
| 4,520,056 | 5/1985 | Jackrel | 428/315 |
| 4,545,841 | 10/1985 | Jackrel | 2/159 X |

FOREIGN PATENT DOCUMENTS

| | | | |
|---|---|---|---|
| 51-53938 | 5/1976 | Japan | 2/169 |

*Primary Examiner*—Peter Nerbun

*Attorney, Agent, or Firm*—Price, Heneveld, Cooper, DeWitt & Litton

[57] ABSTRACT

A glove construction wherein the trank, forchette and thumb piece are stitched together at the outer periphery in the gunn pattern with the liner outside and a water barrier layer inside to form a glove invert with exterior seams; the invert is then reversed to place the barrier layer outside, the liner insert and the seams inverted; an adhesive sealant is then applied along the inverted seams and cured. This reversed glove invert is then placed inside of and secured to an outer shell as of leather.

6 Claims, 20 Drawing Figures

FIG. 2
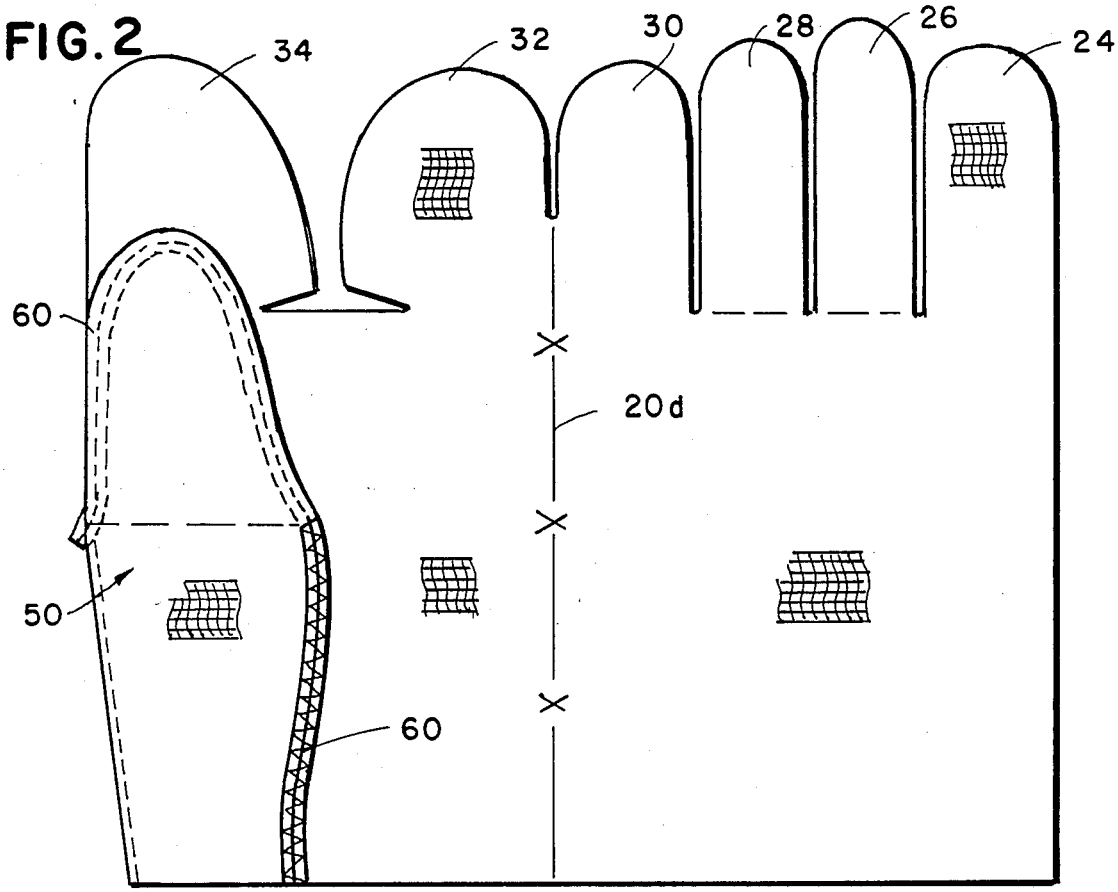
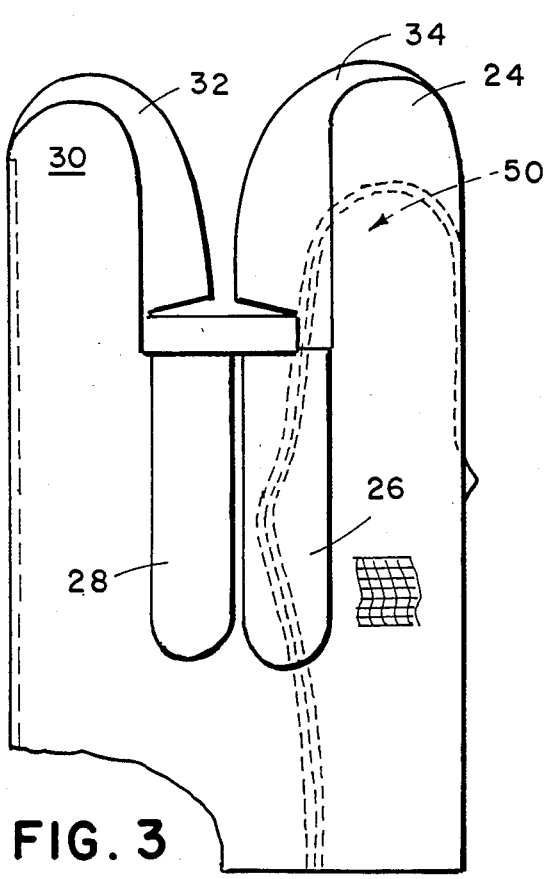
FIG. 3
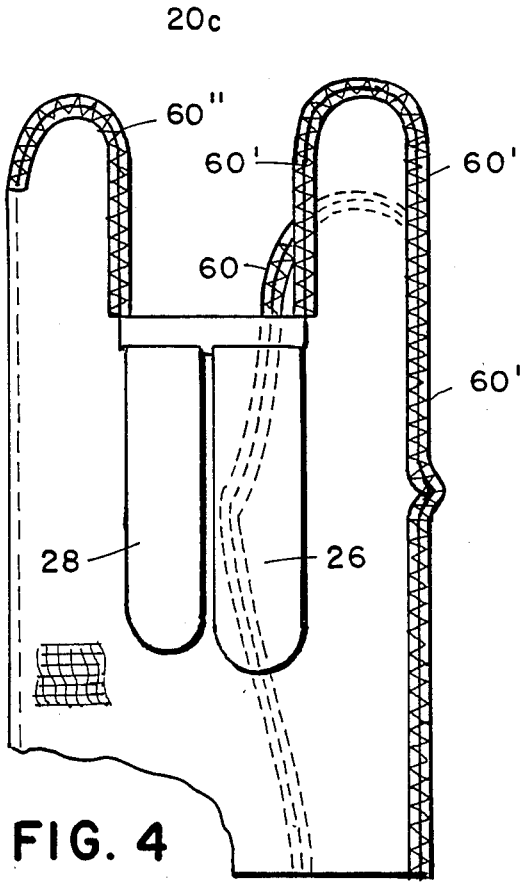
FIG. 4

FIG. 10
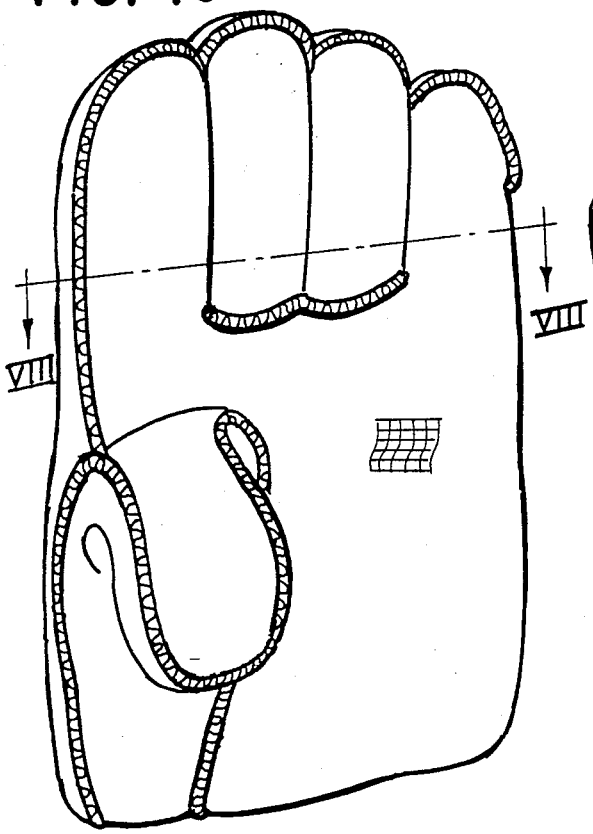
FIG. 11
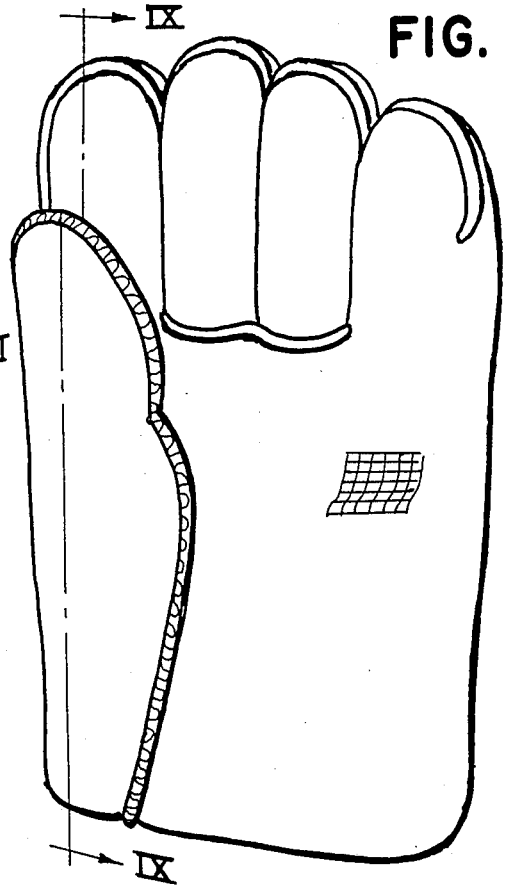
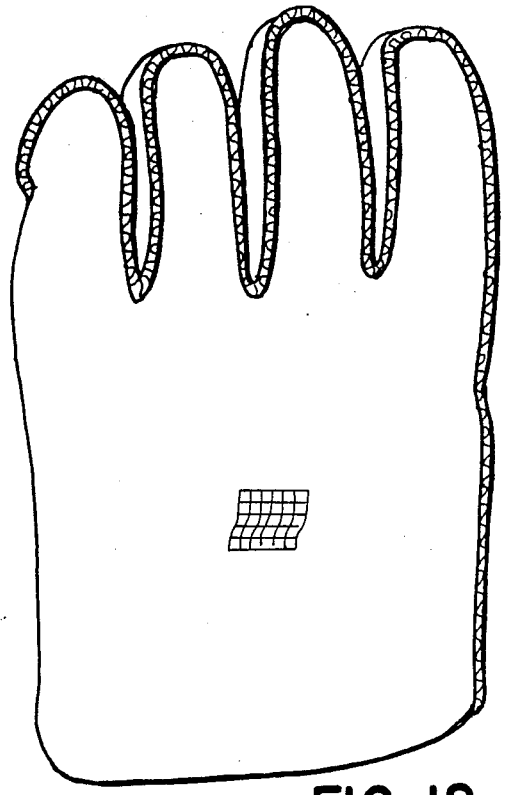
FIG. 12
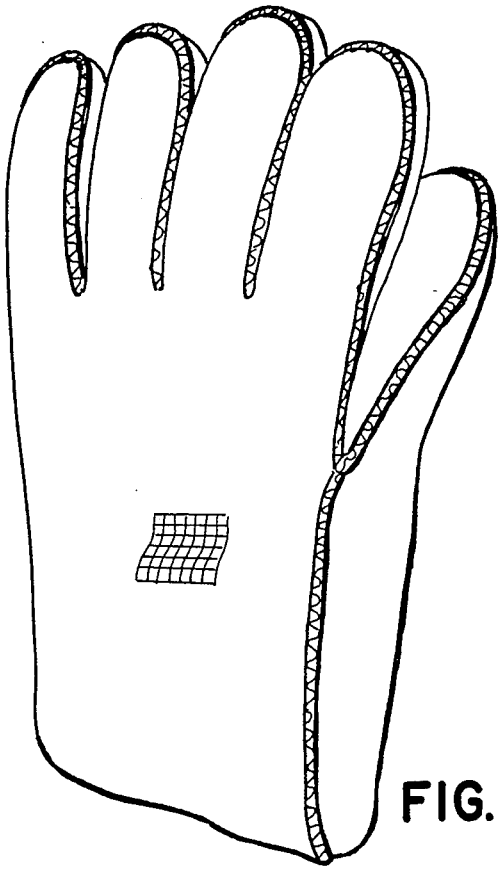
FIG. 13

GLOVE CONSTRUCTION AND METHOD OF MAKING

BACKGROUND OF THE INVENTION

This invention relates to glove manufacture, and more particularly to manufacture of gloves employing a water barrier layer which prevents liquid water ingress but allows moisture vapor egress.

Gloves employing a water barrier layer are generally known as set forth, for example, in U.S. Pat. Nos. 4,430,759; 4,520,056 and 4,545,841. In the construction of such gloves, the inventor has determined that it is advantageous to have the barrier layer peripherally stitched to the liner along seams. The present development enables the barrier layer to be so stitched to the liner, but without the resulting seams serving as wicking entry paths for liquid water.

SUMMARY OF THE INVENTION

In the manufacture of the water repellent gloves of this invention, the trank, forchette and thumb piece components all have a liner layer and a barrier layer. These components are stitched together with the liner layer on the outside and the barrier layer on the inside to form an assembled glove invert with protruding connecting seams at the outer periphery thereof. This invert is then reversed to place the liner on the inside, the seam protrusions on the inside, and the barrier layer on the outside. The reversed outer portions of the seams thus form elongated recesses along the outside periphery. An adhesive sealant, typically in bead form, is then applied along these outside recesses, and subsequently cured. This reversed glove invert is then inserted into a glove shell as of leather or fabric and the two are secured together as by stitching.

An object of this invention is to provide a glove construction preventing liquid water ingress while allowing moisture vapor egress, having an attached barrier layer but without the seams forming wicking water entry paths. The barrier layer is effectively secured to the liner by stitching along peripheral seams but without the seams allowing water passage. Rather, the seams are sealed off during the special assembly method.

BRIEF DESCRIPTION OF THE DRAWINGS

FIG. 2 is an elevational view of the opposite side of the trank with the thumb wrap piece attached;

FIG. 3 is an elevational view of the trank and attached thumb wrap piece of FIG. 2, the trank folded at the seam indicated in FIG. 2, in preparation for stitching of the two outer fingers together;

FIG. 4 is an elevational view of the trank and thumb wrap piece in FIG. 3, with the two outer fingers peripherally stitched;

FIG. 10 is a side perspective view of the glove invert;

FIG. 11 is another perspective view of the glove invert;

FIG. 12 is a back perspective view of the glove invert;

FIG. 13 is another back perspective view of the glove invert;

FIG. 15 is a perspective view of the totally reversed glove invert, with barrier layer out and liner in;

DESCRIPTION OF THE PREFERRED EMBODIMENT

Figure 19:
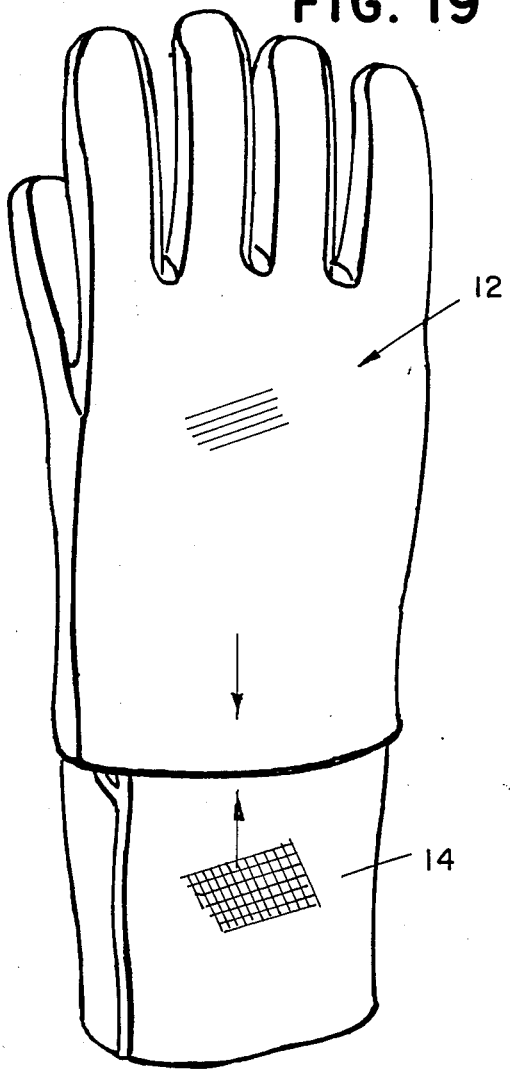
FIG. 19 is a perspective view showing the insertion of the reversed glove invert into a glove shell.
Figure 20:
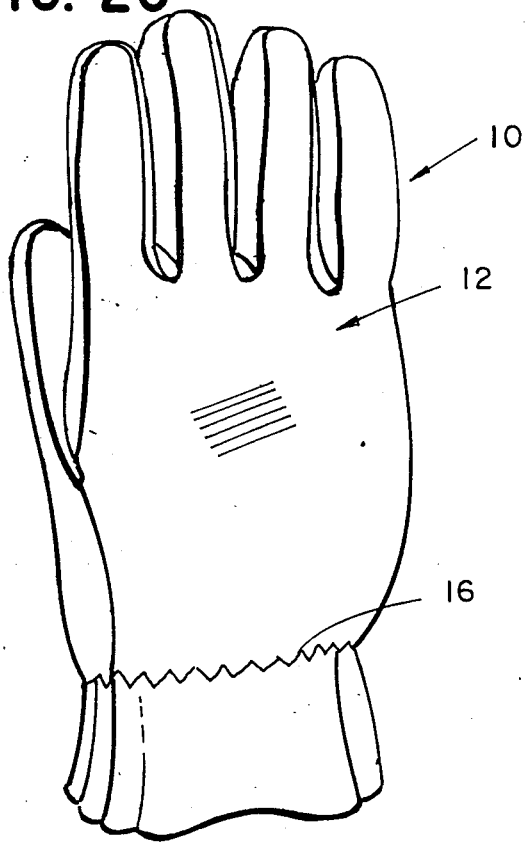
FIG. 20 is a perspective view showing the completed glove with the insert stitched to the glove shell.

Referring now specifically to the drawings, the completed right hand glove 10 (FIG. 20) formed by the method herein is shown to include an outer shell 12 as of leather, fabric or the like, and an assembled insert 14 which is inserted within the shell as shown in FIG. 19, and interconnected by stitching 16 (FIG. 20). This insert is specially assembled from the components depicted in FIG. 1, namely trank 20, forchette 40 and thumb wrap piece 50.

Trank 20 comprises a specially configurated element preferably formed of three layers, namely a barrier layer **20*a* (FIG. 1) which constitutes a barrier against liquid water but is permeable to moisture vapor and air, an insulation layer 20*b* and preferably a fabric inner layer 20*c* on the opposite side of the insulation layer from barrier layer 20*a***. The barrier layer may be of any of several known polymeric materials having microscopic pores small enough to prevent liquid water transfer while allowing moisture vapor transfer. Such materials include those known as "Porelle", "Bion 2 and "Gortex". Reference is made to U.S. Pat. Nos. 4,545,841 to Jackrel and 4,194,041 to Gore. The insulation layer is typically a wool fleece, or a thick porous cloth, natural or synthetic, which may or may not be woven. The fabric layer, if used, is preferably a thin nylon denier such as that known as "Tricot".

Figure 1:
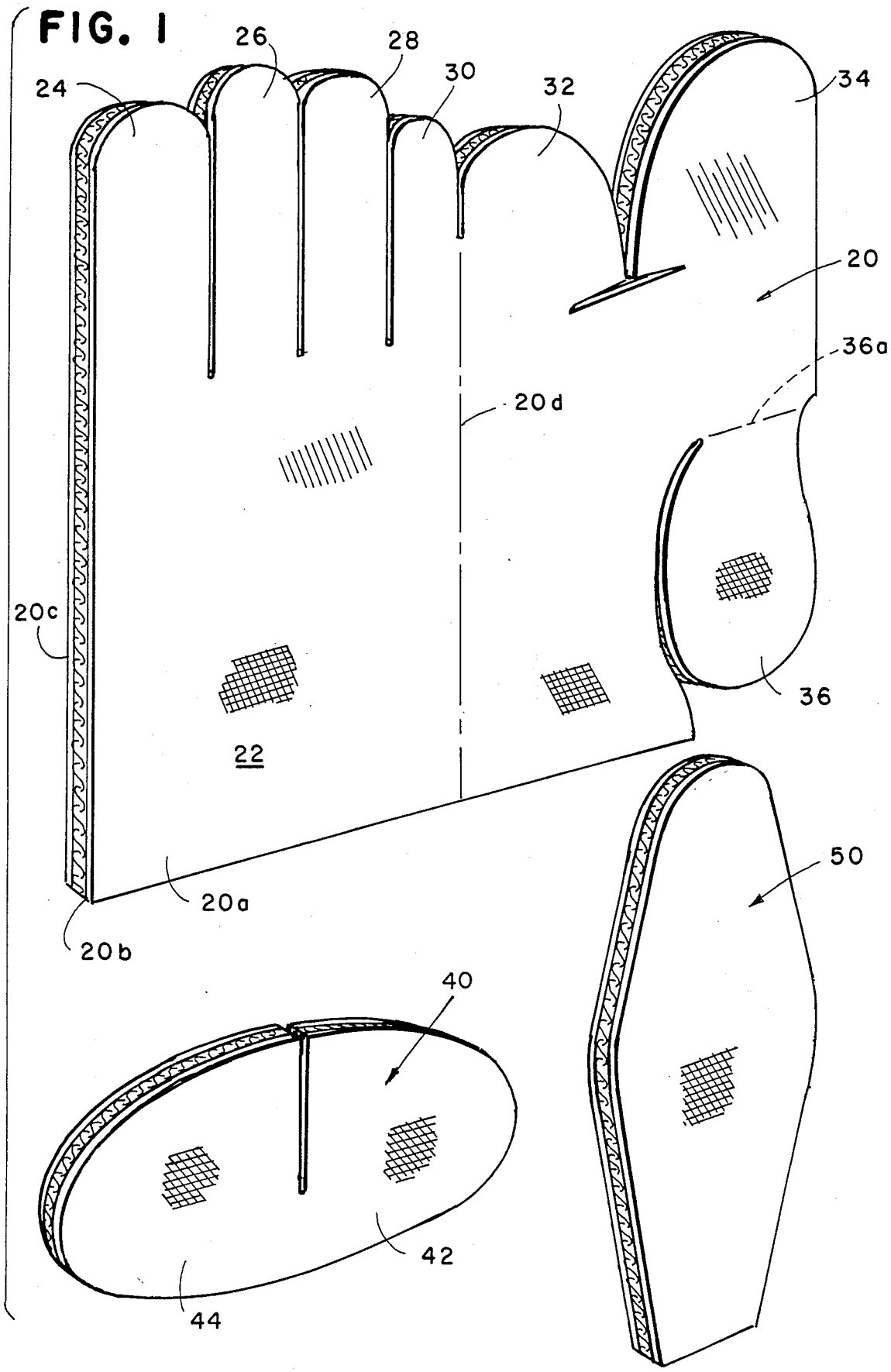
FIG. 1 is an elevational perspective view of the trank, forchette and thumb wrap piece components of a right hand glove insert, not showing the glove outer shell.

These three layers are interconnected as by adhesive in a continuous laminate and then die cut into the component configurations depicted in FIG. 1. They are flexible materials capable of being formed into the desired ultimate three dimensional configuration.

Trank 20 is depicted in FIGS. 1 and 2 with a phantom line **20*d* separating the two halves of the trank. As set forth in FIG. 1, the left half of the trank includes a lower back hand portion 22, a projecting pointer finger back flap 24, an adjacent middle finger back flap 26, a ring finger back flap 28 adjacent the middle finger back flap, and a little finger back flap 30 adjacent the ring finger back flap. On the right half of the trank, there is immediately adjacent the little finger back flap a wider little finger front wrap 32 and adjacent to that an index or pointer finger front wrap 34. Directly beneath this portion 34 is a depending thumb back flap 36**.

Forchette 40 includes two like symmetrical halves 42 and 44 forming the middle finger front wrap and ring finger front wrap. Thumb wrap piece 50 forms the thumb front wrap.

In fabrication of the glove insert, thumb wrap piece 50 is attached to trank 20 by first bending the depending thumb back flap 36 upwardly along its transverse crease line 36*a* so that it lies alongside the pointer finger front wrap 34. Then thumb wrap piece 50 is positioned contiguous thereto, followed by peripheral stitching around the thumb piece and down to the base of the trank as indicated by stitching 60 (FIG. 2). This forms a protruding peripheral seam.

Trank 20 is folded on the phantom line 20*d* with barrier layer 20*a* on the inside of the insert, i.e. the barrier layer on one portion facing the barrier layer on the other portion, while the liner with fabric layer 20*c* is on the outside.

After these portions are folded over one another in the manner indicated (FIG. 3), pointer finger front wrap 34 is curled around and stitched to the pointer finger back flap 24, while little finger front wrap 32 is configurated and stitched to little finger back flap 30 in the manner indicated in FIG. 4 at stitching 60' and 60''.

Figures 5, 6, 7, 8, 9:
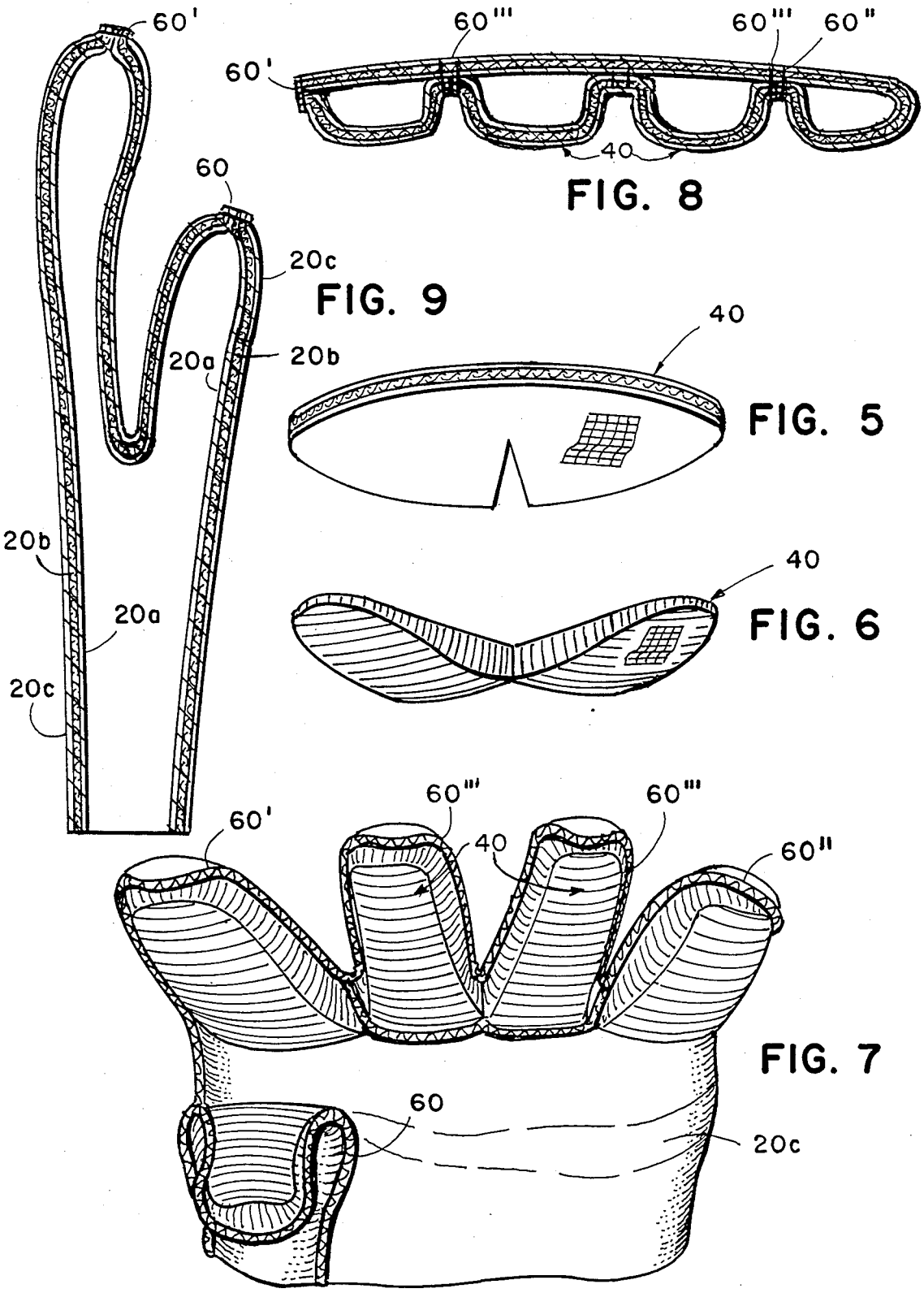
FIG. 5 is a perspective view of the forchette in its flat condition.
FIG. 6 is a perspective view of the forchette curled in order to be stitched to the two center finger flaps on the trank.
FIG. 7 is a perspective view of the glove invert with the forchette and thumb piece stitched to the trank.
FIG. 8 is a cross sectional view through the fingers of the glove invert.
FIG. 9 is a longitudinal cross sectional view of the glove invert.
Figure 14:
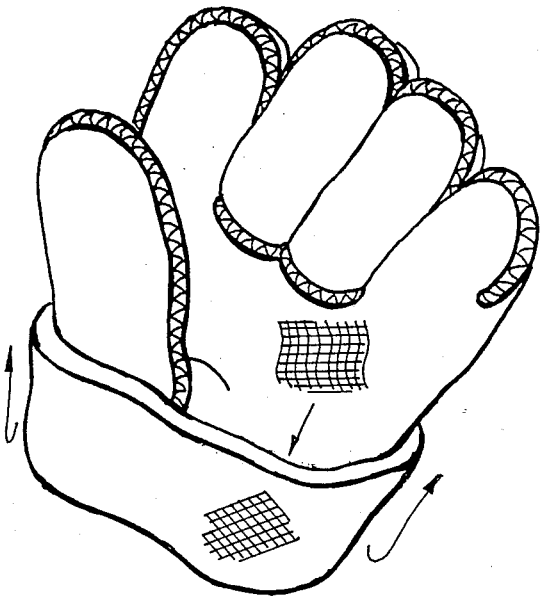
FIG. 14 is a perspective view showing the action of reversal of the glove invert.
Figure 15:
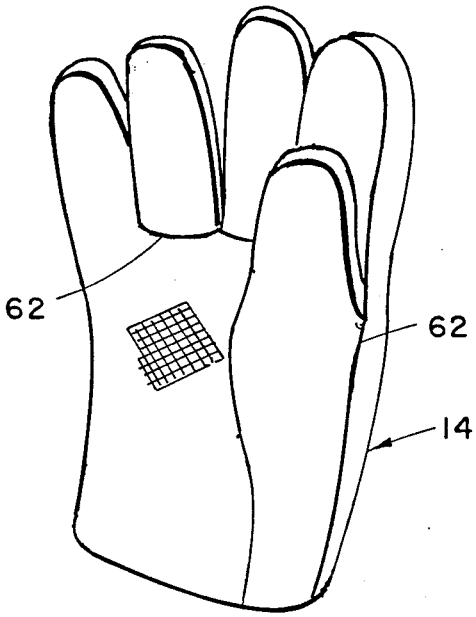

Next, each half of forchette 40 is configurated so that it is altered from the appearance in FIG. 5 to that in FIG. 6, then placed against the back flaps 26 and 28 and peripherally sewn in place as shown by stitching 60''' in FIG. 7. At this time the components in FIG. 1 are interconnected, with the layer of stitching being exposed and protruding at the peripheral portions of the components, and with fabric layer 20*c* being on the exterior while barrier layer 20*a* is on the inside of this glove invert. The extent of the peripheral stitching is more clearly depicted in FIGS. 10 and 11. FIGS. 12 and 13 show the reverse or back side of the right hand glove invert and projecting stitched seams. At this point in the fabrication, the glove invert is reversed, i.e. by turning it inside out, as depicted at the initial stages in FIG. 14. This reversal places the barrier layer on the outside, the fabric liner layer on the inside, the protruding stitching seams on the inside, and an elongated peripheral seam depression or recess 62 (FIG. 15) on the outside of the glove member.

Figure 16:
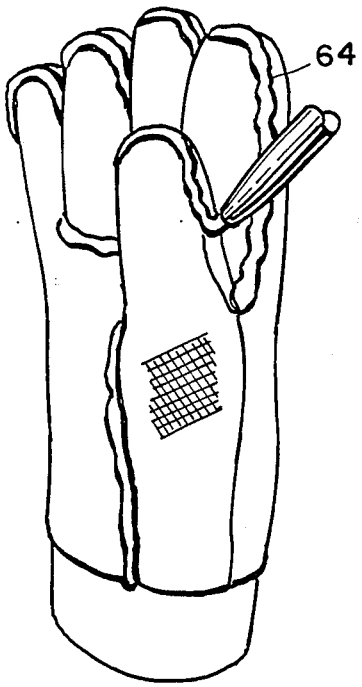
FIG. 16 is a perspective view showing the application of a bead of adhesive sealant into the elongated outside seam recess of the reversed seams.
Figure 17:
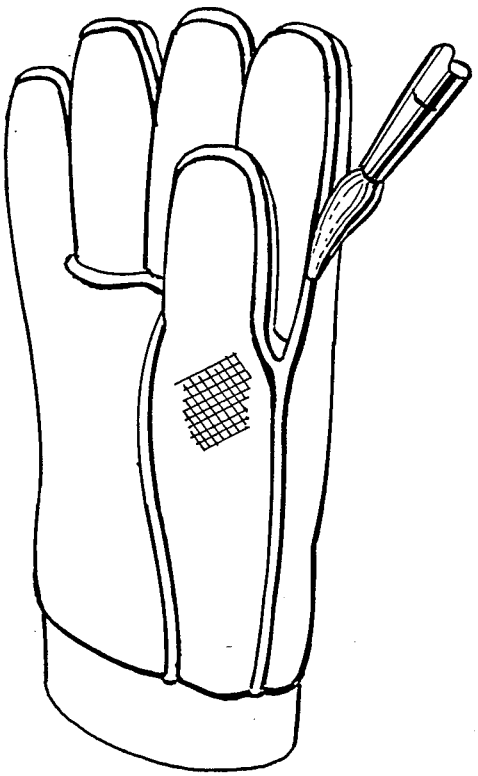
FIG. 17 is a perspective view showing the smoothing step of the adhesive sealant.
Figure 18:
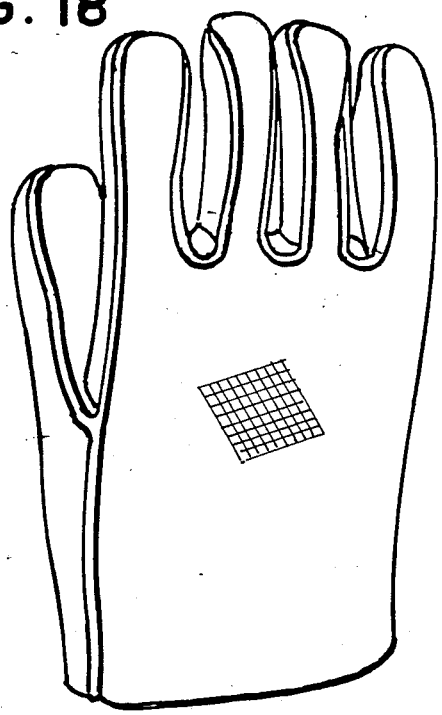
FIG. 18 is a back perspective view of the cured glove invert.

At that point an adhesive sealant is applied (FIG. 16) along this entire seam depression, so as to be over the entire stitched length of the assembled glove components. This can be any suitable waterproof, curable, polymeric sealant which will adhere to the barrier layer, applied as in bead form from a suitable applicator to form a sealing bead 64 (FIG. 16). Preferably this bead is then smoothed as by a brush or the like (FIG. 17) to fully and uniformly fill the depression and effectively seal it against liquid water passage. This adhesive sealant is then cured in any well known fashion such as with heat, infrared radiation, air flow or the like. Thereafter, this completed insert 14, shown to be a right hand glove member, is inserted into a right hand glove shell 12 as of leather, fabric or the like (FIG. 19) and finally stitched together at 16 around the wrist (FIG. 20). The left hand glove is formed in like manner.

It is conceivable that certain minor variations in the technology set forth herein may be made to suit a particular type of material or layered assembly. The invention is intended to be limited only by the scope of the appended claims and the reasonable equivalents thereto.

The embodiments of the invention in which an exclusive property or privilege is claimed are defined as follows:

1. A method of making a glove comprising the steps of:

(a) providing trank, forchette and thumb piece glove components, each having an inner liner layer and a barrier layer adhered to said inner liner layer; and provding a glove shell;

(b) stitching said components together with said inner liner layer on the outside and said barrier layer on the inside to form an assembled glove invert having protruding connecting seams between said components at the outer periphery of said invert;

(c) reversing said glove invert to place said inner liner layer inside, said barrier layer outside, and said protruding seams inside, while creating elongated peripheral depressions along the exterior of said invert seams;

(d) applying an adhesive sealant along said peripheral depressions of said inverted seams, and curing said adhesive sealant thereby sealing said seams to prevent water wicking thereat while said barrier layer allows moisture vapor egress; and (e) securing said reversed glove invert inside said glove shell.

2. The method in claim 1 wherein said inner liner layer comprises a wool fleece layer.

3. The method in claim 2 wherein said inner liner layer also includes a thin fabric on the side of said fleece layer opposite said barrier layer, such that said thin fabric and said barrier layer straddle said fleece layer.

4. The method in claim 1 wherein said reversed glove invert is stitched to said glove shell.

5. The method in claim 1 wherein in said step (d) said adhesive sealant is applied as a bead and then spread along said inverted seams.

6. A glove comprising:

an outer shell and an inner member; said inner member comprising an inner liner layer and an outer water barrier layer attached together along peripheral seams; said seams being inverted with the stitching on the inside of said inner member and an elongated recess along the outside peripehery; and an adhesive sealant in said elongated recess along said seams on the outside of said inner member to prevent water wicking thereat while said barrier layer allows moisture vapor egress.

* * * * *